US011118409B1

(12) United States Patent
Gault et al.

(10) Patent No.: US 11,118,409 B1
(45) Date of Patent: Sep. 14, 2021

(54) SPRING COMPENSATED LUBRICATION SYSTEM FOR SEALED BEARING EARTH BORING BITS

(71) Applicants: Thomas G. Gault, Ada, OK (US); Billy E. Baker, Ada, OK (US)

(72) Inventors: Thomas G. Gault, Ada, OK (US); Billy E. Baker, Ada, OK (US)

( * ) Notice: Subject to any disclaimer, the term of this patent is extended or adjusted under 35 U.S.C. 154(b) by 0 days.

(21) Appl. No.: 16/854,312

(22) Filed: Apr. 21, 2020

Related U.S. Application Data

(60) Provisional application No. 62/836,909, filed on Apr. 22, 2019.

(51) Int. Cl.
*E21B 10/24* (2006.01)
*E21B 10/25* (2006.01)

(52) U.S. Cl.
CPC ..... *E21B 10/24* (2013.01); *E21B 10/25* (2013.01)

(58) Field of Classification Search
CPC combination set(s) only.
See application file for complete search history.

(56) References Cited

U.S. PATENT DOCUMENTS 4,428,687 A * 1/1984 Zahradnik ..... F16J 15/32 175/371
5,586,611 A * 12/1996 Dorosz ..... E21B 10/22 175/369
2010/0230170 A1* 9/2010 Crawford ..... E21B 10/24 175/227

* cited by examiner

*Primary Examiner* — Amber R Anderson
*Assistant Examiner* — Ronald R Runyan
(74) *Attorney, Agent, or Firm* — Gary K. Price

(57) ABSTRACT

A pressure compensating lubrication system for sealed bearing earth boring bits having a lubricant reservoir fitted with a piston. A spring member is disposed between one end of the reservoir and the piston. The spring member applies pressure through the piston to the lubricant in the reservoir and bearing and absorbs pressure fluctuations in the lubricant generated while drilling.

10 Claims, 2 Drawing Sheets

SPRING COMPENSATED LUBRICATION SYSTEM FOR SEALED BEARING EARTH BORING BITS

CROSS REFERENCES TO RELATED APPLICATIONS

U.S. Provisional Application for Patent No. 62/836,909, filed Apr. 22, 2019, with title "Spring Compensated Lubrication System For Sealed Bearing Earth Boring Bits" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The invention relates generally to sealed bearing earth boring bits and, more particularly, to the lubrication system(s) utilized in such bits.

2. Brief Description of Prior Art

In sealed bearing rolling cutter earth boring bits, a lubrication system is generally provided to maintain substantially equal pressure on both sides of the bearing seal and absorb pressure fluctuations generated during the drilling operation. The lubrication system generally includes the bearing seal, a reservoir filled with lubricant, typically a high viscosity petroleum grease with friction reducing additives, passage(s) connecting the reservoir to the space between the bearing parts (bearing cavity) and a flexible membrane separating and sealing the lubricant reservoir from contaminants external to the bit. The flexible membrane functions as a pressure compensator maintaining substantially equal pressure on both sides of the bearing seal and absorbing pressure fluctuations. Most of the sealed lubrication systems further include some means to relieve excessive pressure which can occur in the system during application due to high temperatures.

The lubrication systems as described above is typically used in rotary rock bits used in drilling oil and gas wells where the pressure outside the bit may be a few hundred to several thousand pounds per square inch (PSI).

An object of the present invention is to provide an improved lubrication system utilizing a spring compensated lubrication system to maintain a positive pressure in the lubricant and replenish any lubricant loss from the system.

SUMMARY OF THE INVENTION

Rolling cutter earth boring bits are generally constructed of two or more cutter assemblies. Each cutter assembly consists of two major parts, a body part with an integral or attached bearing journal and a generally conical shaped cutter part rotatable about the bearing journal. The object of the present invention is to provide an improved lubrication system for sealing bearing roller cutter earth boring bits drilling at or near atmospheric pressure conditions, utilizing a spring biased piston to maintain a positive pressure in the lubricant, to absorb fluctuations in pressure generated during the drilling operation, and move lubricant from the reservoir to the space between the body part and the cutter part (bearing cavity) in the event of lubricant loss from the system during use.

The current invention describes a lubrication system comprised of a bearing seal, a first cylindrical recess in the body part forming a lubricant reservoir, the first end of which terminates in a second cylindrical recess extending to the exterior of the body part, passage(s) from the first or second cylindrical recess to the bearing cavity, a cylindrical body positioned in the second cylindrical cavity with seal means to seal the lubricant reservoir from the exterior of the cutter assembly, and a spring and piston positioned in the lubricant recess to maintain a positive pressure in the lubricant and replenish any lubricant loss from the system. A passage from the second end of the first cylindrical recess exposes the back side of the piston to the ambient pressure external to the cutter assembly.

DESCRIPTION OF THE PREFERRED EMBODIMENT

Figure 1:
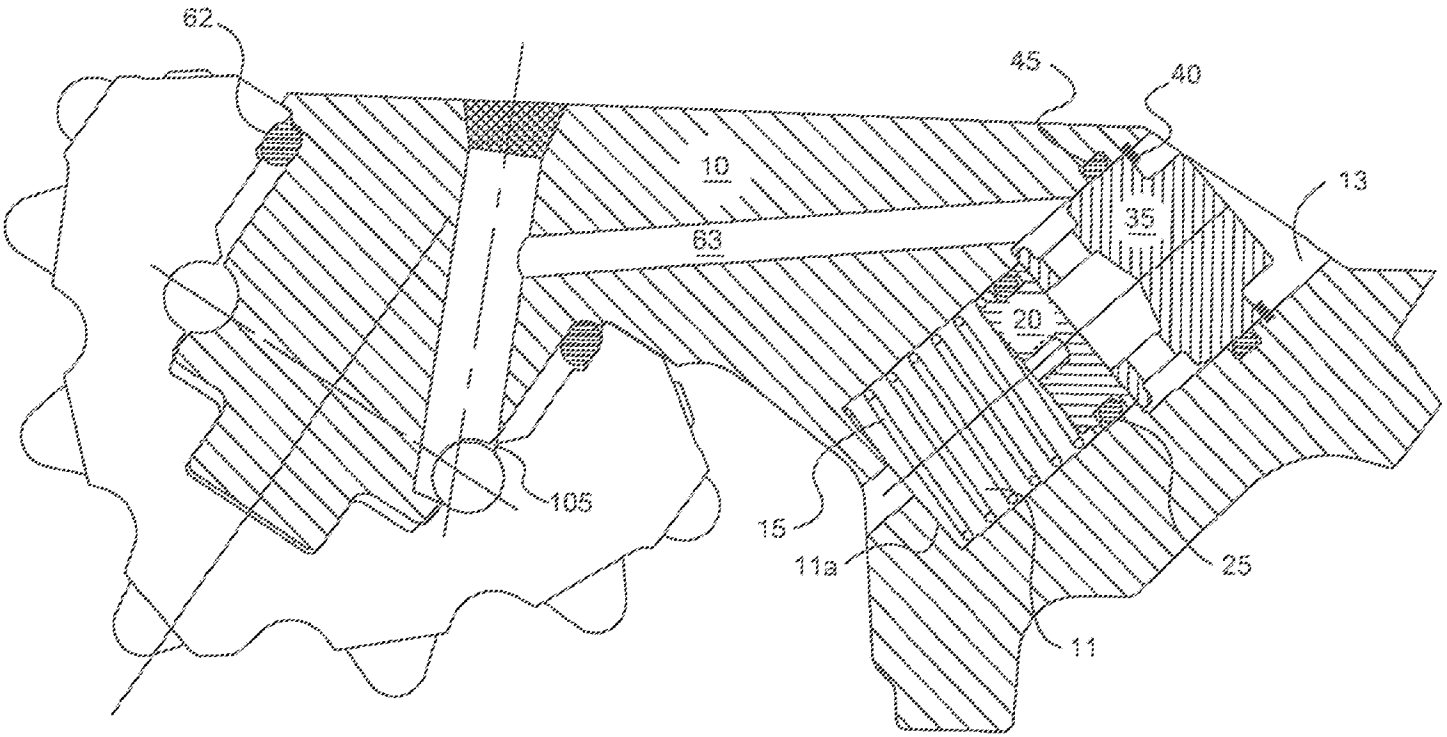
FIG. 1 is a section view illustrating the spring-biased piston compensated lubrication system forming the present invention mounted in the body of a cutter assembly for an earth boring bit.

A compensator system is included in sealed bearing cutter assemblies of earth boring bits for the purpose of maintaining substantially equal pressure across the bearing seal, absorbing pressure fluctuations in the grease generated by the cone motion while drilling, and moving grease from the reservoir to the bearing to replace any grease loss while drilling. The present invention is directed to a spring-biased compensated lubrication system to provide an improved bit for drilling applications where preferably the ambient pressure around the bit is less than three (3) atmospheres. However, this would not preclude the use of the present invention in bits drilling in higher pressure environments. In the broadest context, the spring compensated lubrication system of the present invention consists of components configured and correlated with respect to each other so as to attain the desired objective.

The preferred embodiment of the present invention is enclosed in a cutter assembly body 10 with a preferably cylindrical first recess 11 defining a first end 11*a* and a second end 11*b* that terminates in a second preferably concentric cylindrical recess 13 that extends to the exterior of body 10. The second end 11*b* is in fluid communication with the space between bearing surfaces (bearing cavity) 105 through passage 63, and provides fluid communication to the bearing cavity 105 and the interior of the recess 11. The recess 11 is sized of a diameter and with a longitudinal length for receiving a piston 20 and forming a reservoir 30 for receiving lubricant.

The piston 20 is slidably disposed within the recess 11 and has a dynamic seal 25 that may be provided by an elastomeric member, such as an O-ring. A compression spring member 15 provides a bias member disposed adjacent the piston 20 such that the piston 20 is positioned between the spring member 15 and lubricant reservoir 30. The spring member 15 is disposed with one end adjacent the first end

11*a* of the first recess 11, and the opposite end of spring member 15 adjacent the piston 20.

A generally cylindrical cap 35 with a resilient seal ring 45, preferably of the O-ring type is positioned in recess 13 adjacent the second end 11*b* of recess 11 and adjacent the reservoir 30. The cap 35 is retained in recess 13 by snap ring 40. The cap 35 is generally configured to seal the reservoir 30 from external pressure. Seal 62, generally of the O-ring type, is provided for sealing the bearing 105. The piston seal 25, cap seal 45, and bearing seal 62 form a closed volume for the lubricant and prevents contamination of the lubricant by drilling debris.

Figure 2:
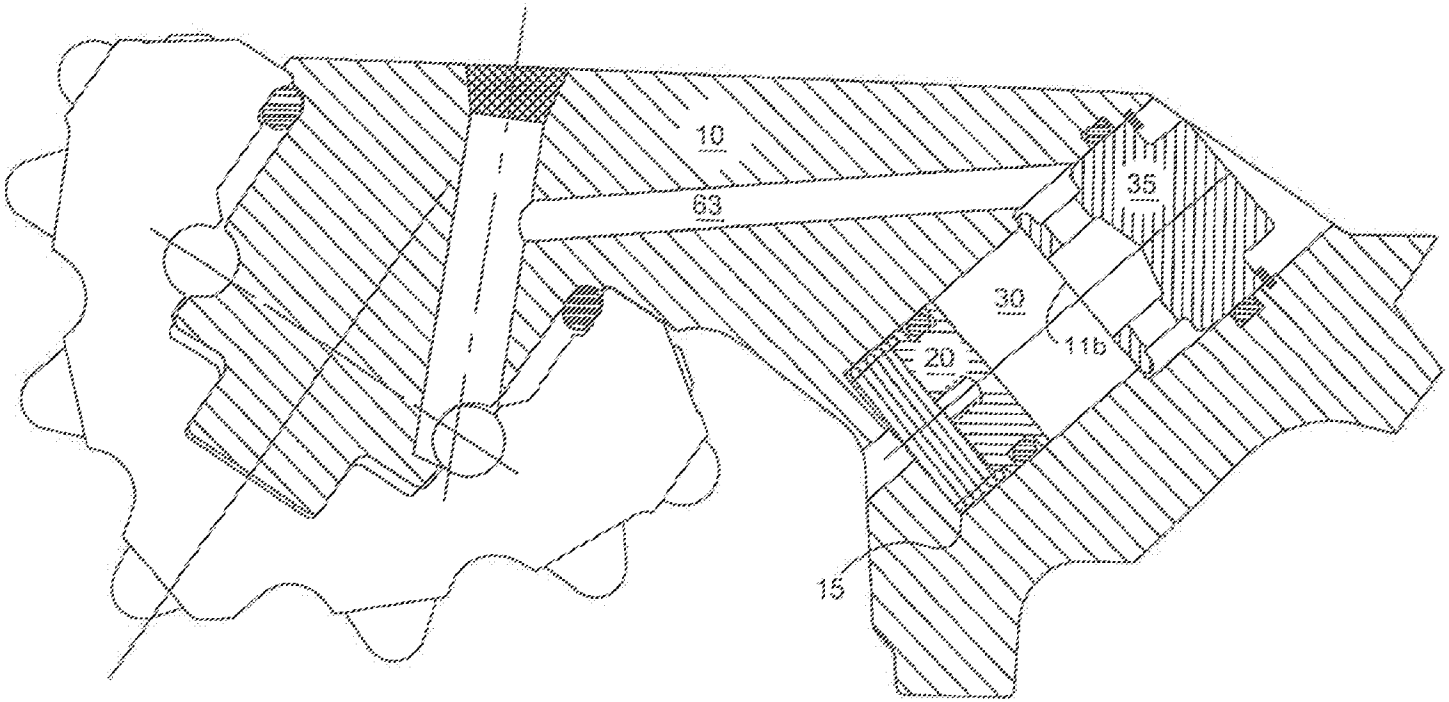
FIG. 2 illustrates the spring compensated lubrication system of FIG. 1 with the spring member within the lubrication system in a compressed state.

The earth boring bit is initially operated with lubricant filling the reservoir 30, second recess 13, and passage 63, with the spring member 15 in the compressed state as shown in FIG. 2. The piston 20, the piston seal 25 and spring member 15 together provide a moveable seal member that together provide a pressure force to the lubricant. In the event of lubricant leakage during drilling, pressure build-up within the bearing cavity 105 will push the spring member 15 towards an extended state (see FIG. 1), forcing the piston 20 into the reservoir 30 to replenish any lubricant loss from the bearing cavity 105.

Although the above description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

We claim:

1. A spring-biased compensated lubrication system enclosed in a cutter assembly body, said system comprising:

a first cylindrical recess defining a first end and a second end adjacent to a second cylindrical recess that extends to an exterior of the cutter assembly body, said first cylindrical recess having a first diameter and a longitudinal length that extends from said first end to said second end for receiving a piston and forming a reservoir for receiving lubricant, wherein said second cylindrical recess having a second diameter that is larger than said first diameter, and said second cylindrical recess is in fluid communication with a bearing cavity within the cutter assembly body, said bearing cavity including a first seal, said piston slidably disposed within said first cylindrical recess and includes a second seal configured to seal lubricant within the system from external fluid, a compression spring disposed adjacent said piston so that the piston is positioned between said compression spring member and said reservoir disposed within said first cylindrical recess such that a first end of said compression spring is adjacent said first end of said first cylindrical recess and a second, opposite end of said compression spring member is adjacent said piston, and wherein said compression spring and said piston are configured to extend said longitudinal length, a generally cylindrical cap with a third seal is positioned within said second cylindrical recess adjacent the second end of the first cylindrical recess and the lubricant reservoir, and wherein said generally cylindrical cap is retained in said second cylindrical recess by a snap ring, a first passage from the first end of the first cylindrical recess exposes a back side of the piston to ambient pressure external to the cutter assembly, and wherein said first, second and third seals form a closed volume for the lubricant and prevents contamination of the lubricant.

2. The system of claim 1, wherein said first, second and third seals are each of the O-ring type.

3. The system of claim 1, wherein said piston, said second seal and said compression spring member together provide a moveable seal member that provides a pressure force to the lubricant within the first cylindrical recess.

4. The system of claim 3, wherein said compression spring member has a compressed state and an extended state where the spring member forces the piston into the reservoir to replenish any lubricant loss from the bearing cavity.

5. The system of claim 1, wherein a second passage extends from the second cylindrical recess in fluid communication with said bearing cavity within the cutter assembly body.

6. A spring-biased compensated lubrication system enclosed in a cutter assembly body, said system comprising:

a first cylindrical recess having a first diameter and a second cylindrical recess having a second diameter, and wherein said second diameter is larger than said first diameter, and said second cylindrical recess extends to an exterior of the cutter assembly body, said first cylindrical recess having a longitudinal length that extends from a first end of said first cylindrical recess to a second end for receiving a piston and forming a reservoir for receiving lubricant, wherein said second cylindrical recess is in fluid communication with a bearing cavity within the cutter assembly body, said bearing cavity including a first seal, said piston is slidably disposed within said first cylindrical recess and includes a second seal, a compression spring disposed adjacent said piston so that the piston is positioned between said compression spring member and said reservoir such that a first end of said compression spring member is adjacent the first end of said first cylindrical recess and a second, opposite end of said compression spring member is adjacent said piston, and wherein said compression spring and said piston are configured to extend said longitudinal length, a generally cylindrical cap with a third seal is positioned within said second cylindrical recess adjacent the lubricant reservoir, and wherein said generally cylindrical cap is retained in said second cylindrical recess by a snap ring, a first passage from the first end of the first cylindrical recess exposes a back side of the piston to ambient pressure external to the cutter assembly, and wherein said piston, said second seal and said compression spring member together provide a moveable seal member that provides a pressure force to the lubricant within the first cylindrical recess.

7. The system of claim 6, wherein said first, second and third seals form a closed volume for the lubricant and prevents contamination of the lubricant.

8. The system of claim 7, wherein said first, second and third seals are each of the O-ring type.

9. The system of claim 8, wherein said compression spring member has a compressed state and an extended state where the spring member forces the piston into the reservoir to replenish any lubricant loss from the bearing cavity.

10. The system of claim 6, wherein a second passage extends from the second cylindrical recess in fluid communication with said bearing cavity within the cutter assembly body.

* * * * *